United States Patent [19]

Maltby

[11] 3,946,587

[45] Mar. 30, 1976

[54] ROLLING MILLS

[75] Inventor: Jack Maltby, Sheffield, England

[73] Assignee: Davy-Loewy Ltd., Sheffield, England

[22] Filed: Dec. 4, 1974

[21] Appl. No.: 529,322

[30] Foreign Application Priority Data

Dec. 6, 1973 United Kingdom ..... 56497/73

[52] U.S. Cl. ..... 72/237; 72/238

[51] Int. Cl.[2] ..... B21B 31/08

[58] Field of Search ..... 72/237, 245, 234, 235, 72/238, 109, 111

[56] References Cited

UNITED STATES PATENTS

| | | | |
|---|---|---|---|
| 355,390 | 1/1887 | Daniels | 72/238 |
| 682,209 | 9/1901 | Lemmert | 72/109 |
| 1,900,032 | 3/1933 | Worthington | 72/247 X |
| 3,076,360 | 2/1963 | Sendzimir | 72/242 |
| 3,576,121 | 4/1971 | Greis | 72/91 |
| 3,587,267 | 6/1971 | Townsend et al. | 72/21 |
| 3,628,594 | 12/1971 | Reinfeld | 72/245 |
| 3,818,742 | 6/1974 | Maltby et al. | 72/238 |

*Primary Examiner*—Milton S. Mehr
*Attorney, Agent, or Firm*—Daniel Patch; Henry C. Westin

[57] ABSTRACT

A rolling mill stand for hot or cold rolling rod and flats has a C-shaped housing and a bolt connecting the protruding ends of the housing. The work rolls are mounted in cantilever fashion and are carried in chocks which are restrained by the housing. The chocks are pivoted to the housing about pivot pins, the axes of which are parallel to the axes of the work rolls and are displaced from the plane through the roll axes. Pivoting of the chocks about the pivot pins in order to vary the separation of the work rolls does not affect the shape of the roll gap.

4 Claims, 2 Drawing Figures

ROLLING MILLS

This invention relates to rolling mills, and is particularly concerned with rolling mill stands for rolling metallic rod, angles, flats, narrow strip and like sections. The stand of the present invention may be employed for both hot-and-cold - rolling ferrous and non-ferrous metals.

Cantilever rod mills have previously been proposed, employing chocks which are pivoted to the stand housing about axes extending generally parallel to the rod pass-line. Such stands have however suffered from the considerable disadvantage that the profile of the rolling hole varies as the roll gap is changed by pivoting the chocks about their pivot axes. The principle of those stands cannot therefore be applied to mills for rolling sections, and in particular narrow strip, where there is a danger of producing rolled material having a thickness which varies across the width.

In accordance with one aspect of the present invention, a rolling mill stand comprises a housing, a pair of chocks for carrying opposed roll assemblies, means for pivoting each chock separately to the housing about an axis parallel to the roll axes and displaced from the plane of the roll axes. Each roll assembly may comprise a single roll, or the combination of a work roll and a back-up roll; in the latter case "the plane of the roll axis" is the plane through the axes of the back-up rolls, where the work rolls and back-up rolls do not have their axes in a common plane.

A preferred form of the invention resides in a cantilever rolling mill stand comprising a housing which includes a C-shaped housing member and a removable bolt restraining separating movement of the protruding ends of the housing member, a window being formed between the housing member and the bolt; a pair of roll carrying chocks located in the window and pivoted to the housing member about separate axes which lie parallel to the roll axes and which are displaced from the plane through the roll axes; and roll gap adjustment means arranged between a first of the chocks and the housing member; the second of the chocks being restrained in movement away from the first chock by engagement with the housing member. The roll gap adjustment means may include a screwdown mechanism or a wedge mechanism, but preferably comprises a hydraulic capsule, with position control.

Figure 1:
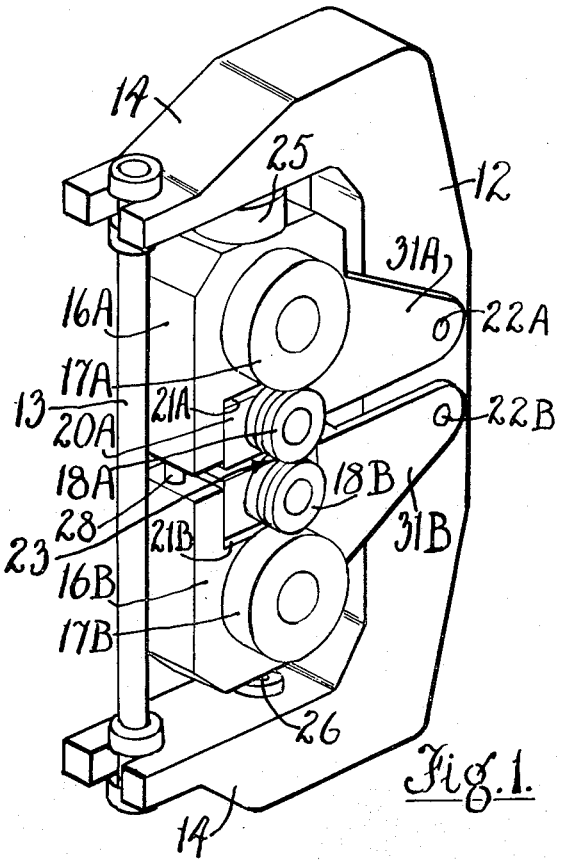
Figure 2:
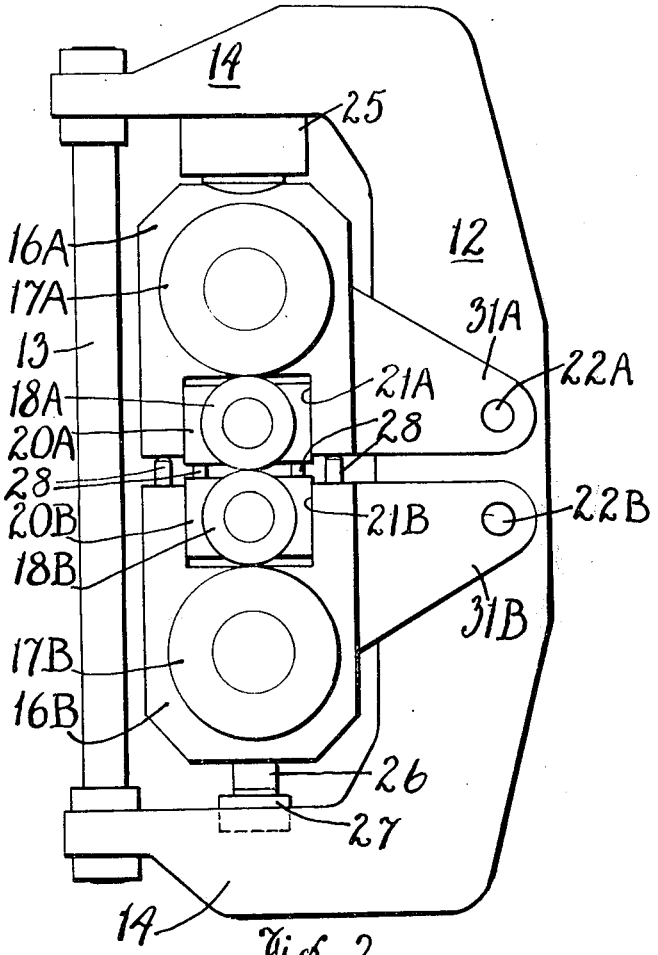

The invention will be more readily understood by way of example from the description of a cantilever rod mill stand in accordance therewith, reference being made to the accompanying drawings in which FIG. 1 is a perspective view of the stand, and FIG. 2 is a side view of the same stand.

Referring to the drawings, the stand has a C-shaped housing 12 which is closed by a bolt 13 received in slots in the protruding parts 14 of the housing. Bolt 13, which may be prestressed, restrains separating movement of the parts 14 under the action of the rolling load.

A window 15 is formed between the housing 12 and the bolt 13. Within that window are located two chocks 16A, 16B carrying the rolls of the two roll assemblies. Thus, chock 16A is shown as having journalled therein an upper, cantilever, back-up roll 17A and an upper, cantilever, work roll 18A, the latter being carried in a work roll chock 20A which slides within a slot 21A in chock 16A. The lower chock 16B is similar to chock 16A and similarly carries lower back-up and work rolls 17B, 18B respectively.

Each chock 16 has a pair of rearwardly extending, integral, wings 31A or 31B, which straddle the housing 12 and which are pivoted to the housing by a hinge pin 22A or 22B. As will be clear from the drawing, each of the hinge pins 22 extends parallel to the axes of the rolls 17, 18 and is displaced from the common plane through the roll axes. Because of the pivotal mounting of the chocks 16, the roll gap may readily be adjusted, the chocks turning about the pins 22 until the required separation has been achieved. Furthermore, the profile of the work roll hole 23 is unaffected by roll gap adjustment, apart of course from the separation of the work rolls.

While any of a number of methods may be used for controlling and adjusting the roll gap, the arrangement shown in FIG. 2 makes use of a hydraulic piston and cylinder assembly 25 arranged between the upper protruding part 14 of the housing 12 and the upper chock 16A. That assembly 25 is provided with position control so that the piston of the assembly, and therefore the upper chock 16A is held at a required position relative to the housing.

The lower chock 16B is spaced from the housing by a loadcell 26 and a wedge mechanism 27, the latter being manually operable to re-position the pass-line of the stand after a roll change. Balance cylinders 28 are as usual provided between the chocks 16 and between the chocks 20.

Because the rolls 17, 18 are mounted in cantilever manner, they may be removed and replaced without removal of the chocks 16, 20 from the housing; roll change is thus simplified. When more comprehensive servicing of the stand is necessary, the stand as a whole is removed from the mill train and replaced by a substitute stand. Maintenance on the removed stand is simplified by the provision of the removable bolt 13, since on its removal, the chocks 16 with their rolls may be readily withdrawn from the housing, once the pins 22 have been released. Access may then be had to the hydraulic assembly 25, the loadcell 26 and the wedge mechanism 27.

While a stand having both back-up and work rolls is shown in the drawings, the chocks 16 may instead carry a single work roll, the chocks 16 being modified accordingly.

Although the stand shown is designed for rolling rod, by appropriate choice of the work roll hole, it can be adapted for rolling other sections, such as angles, flats and narrow strip. Regardless of the relative disposition of the wings 31 of the two chocks, the thickness of rolled strip remains uniform across its width.

Two stands each similar to that shown in the drawings may be mounted on a common base plate, with the plane through the roll axes of one stand at right angles to the plane through the roll axes of the other, so that the work is rolled down successively in directions at right angles. When rolling square or rectangular sections, one of the stands then rolls the work on two opposed faces, while the other stand edge rolls the work. The stands may be arranged with the planes of the roll axes at 45° to the vertical.

The stand may be used either for hot rolling or for cold rolling.

In accordance with the provisions of the patent statutes, I have explained the principle and operation of my invention and have illustrated and described what I consider to represent the best embodiment thereof.

I claim:

1. A cantilever rolling mill stand comprising a generally C-shaped housing member; a pair of roll carrying chocks located between the protruding arms of the housing member and pivoted to the housing member about separate axes which lie parallel to the roll axes and which are displaced from the plane through the roll axes; roll gap adjustment means arranged between a first of the chocks and a first of the arms of the housing member; and further adjustment means located between the second of said chocks and the other arm of said housing member.

2. A cantilever rolling mill stand according to claim 1, in which each chock carries a back-up roll in cantilever manner, and additionally supports a work-roll chock which carries a work roll also in cantilever manner.

3. A cantilever rolling mill stand according to claim 1, in which the roll gap adjustment means is a hydraulic piston and cylinder assembly, which is carried by the housing member and against which the first chock abuts.

4. A cantilever rolling mill stand according to claim 1, in which said further adjustment means is a wedge mechanism.

* * * * *